US011745511B2

(12) United States Patent
Oki et al.

(10) Patent No.: US 11,745,511 B2
(45) Date of Patent: Sep. 5, 2023

(54) INK TANK AND IMAGE RECORDING APPARATUS

(71) Applicant: BROTHER KOGYO KABUSHIKI KAISHA, Nagoya (JP)

(72) Inventors: Satoru Oki, Nagoya (JP); Yoshinori Osakabe, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 37 days.

(21) Appl. No.: 17/480,417

(22) Filed: Sep. 21, 2021

(65) Prior Publication Data

US 2022/0097393 A1 Mar. 31, 2022

(30) Foreign Application Priority Data

Sep. 30, 2020 (JP) ..... 2020-166285

(51) Int. Cl.
*B41J 2/175* (2006.01)

(52) U.S. Cl.
CPC ..... *B41J 2/17509* (2013.01); *B41J 2/1754* (2013.01); *B41J 2/17513* (2013.01); *B41J 2/17553* (2013.01); *B41J 2/17566* (2013.01); *B41J 2/17596* (2013.01)

(58) Field of Classification Search
CPC .. B41J 2/17509; B41J 2/17513; B41J 2/1754; B41J 2/17553; B41J 2/17566; B41J 2/17596; B41J 2002/17573; B41J 29/13; B41J 29/02
USPC ..... 347/86
See application file for complete search history.

(56) References Cited

U.S. PATENT DOCUMENTS

2014/0104347 A1* 4/2014 Iizawa ..... B41J 2/17513 347/85
2021/0291536 A1* 9/2021 Cantrell ..... B41J 2/1754

FOREIGN PATENT DOCUMENTS

WO 2019/078898 A1 4/2019

* cited by examiner

*Primary Examiner* — Matthew Luu
*Assistant Examiner* — Alexander D Shenderov
(74) *Attorney, Agent, or Firm* — Merchant & Gould P.C.

(57) ABSTRACT

An ink tank includes: a first liquid storage chamber having a lower limit indicator; a second liquid storage chamber; a liquid inlet communicated with the first liquid storage chamber; a cap openable or closeable the liquid inlet; a rotation shaft extending from an inside of the first liquid storage chamber to an outside through a through hole provided on a side wall of the first liquid storage chamber; a valve member opening or closing the communication passage; a first lever arm rotatable around the rotation shaft and connected to the valve member; a second lever arm provided outside the ink tank and rotatable around the rotation shaft; and a slider member connected to the second lever arm and movable in conjunction with the cap, the through hole being provided at a position above the lower limit indicator.

15 Claims, 5 Drawing Sheets

INK TANK AND IMAGE RECORDING APPARATUS

CROSS-REFERENCE TO RELATED APPLICATIONS

This application is based on and claims priority under 35 USC 119 from Japanese Patent Application No. 2020-166285 filed on Sep. 30, 2020, the contents of which are incorporated herein by reference.

TECHNICAL FIELD

The present disclosure relates to an ink tank storing ink and an image recording apparatus including the ink tank.

BACKGROUND

In a recent year, there is an image recording apparatus having an ink tank capable of filling and refilling ink. FIG. 1A illustrates an example of an image recording apparatus 300. As illustrated in FIG. 1A, the image recording apparatus 300, which is an example of the inkjet recording apparatus, has a substantially rectangular parallelepiped shape. The image recording apparatus 300 includes a scanner above the image recording apparatus 300, which reads an image recorded on a document such as paper by an image sensor (not illustrated) and acquires image data. Further, a printer for recording an image on a sheet is provided in a lower part of the image recording apparatus 300. The printer includes an inkjet recording type recording head 310 as an example of a liquid consumption device.

In the following description, an up-down direction is defined with reference to a posture (the posture illustrated in FIGS. 1A and 1B and it may be referred to as "usage posture".) in which an ink tank mounted on the image recording apparatus 300 is installed in a horizontal plane for use. Further, a front-rear direction is defined with a side on which an opening and closing cover 307 is provided as a front side and a left-right direction is defined when the image recording apparatus 300 is viewed from the front side. In the illustrative embodiment, in the usage posture, the up-down direction corresponds to a vertical direction and the front-rear direction and the left-right direction correspond to a horizontal direction.

In the image recording apparatus 300 of FIG. 1A, the opening and closing cover 307 which can be opened or closed is in an open position. In the image recording apparatus 300, three ink tanks 303 in which three colors of CMY (Cyan, Magenta, Yellow) ink are stored are arranged on a front left side of the device. Of these three ink tanks 303, a cap 304 of the leftmost ink tank 303 is in an open position and caps 304 of the other two ink tanks 303 are in a closed position. On the other hand, an ink tank 303 containing BK (Black) ink is arranged on a front right side of the image recording apparatus 300. A cap 304 of the ink tank 303 for BK is in the closed position. When the opening and closing cover 307 is in the open position, a user can access these ink tanks 303, that is, supply or replenish ink. FIG. 1B is an enlarged view of a front portion 302 of the three ink tanks 303 arranged on the front left side.

A schematic structure of the ink tank 303 mounted on the image recording apparatus 300 will be described below with reference to FIGS. 2 to 4. FIG. 2 is a side view of the ink tank 303 as viewed from a left side. Since a transparent film 110 is welded to a left side surface of the ink tank 303, an internal structure of the ink tank 303 can be visually recognized. FIG. 3 is a perspective view illustrating only a link mechanism 200 used in the ink tank 303. FIG. 4A is a schematic view illustrating the ink tank 303 in a state where a valve is sealed by the cap 304 in an open position and FIG. 4B is a schematic view illustrating the ink tank 303 in a state where the valve is opened by the cap 304 in a closed position. However, FIGS. 4A and 4B do not illustrate a second ink chamber 401 provided below the first ink chamber 301.

As illustrated in FIG. 2, in the ink tank 303, the cap 304 is rotatably attached to an ink tank body 306. The cap 304 is able to seal an injection cylinder 305. The cap 304 is always urged from the closed position to the open position by an elastic body (rubber O-ring as an example) (not illustrated). When an engagement that holds the cap 304 in the closed position is released, the cap 304 rotates by itself from the closed position in which the injection cylinder 305 is sealed to the open position. Further, the cap 304 includes a protrusion 201 which extends downward when in the closed position, as illustrated in FIG. 3. When the cap 304 is in the open position, the protrusion 201 is separated from a slider member 202 described below. However, when the cap 304 is in the closed position, the protrusion 201 presses the slider 202 downward.

Next, the link mechanism 200 will be described with reference to FIG. 3. The link mechanism 200 is a mechanism for connecting the cap 304 and the valve body 207 in order to link an operation of the cap 304 with an operation of the valve body 207 described below.

The link mechanism 200 is composed of the slider member 202, a second lever arm 203, a first lever arm 206, a compression spring 204, a plurality of rubber O-rings, and the like.

The slider member 202, the second lever arm 203, and the compression spring 204 are arranged on the outside of the ink tank 303, that is, on a right wall of the ink tank 303. Further, a rotation shaft 205 of the first lever arm 206 penetrates a through hole 205A provided in the right wall forming the first ink chamber 301 from the inside of the first ink chamber 301 toward the outside of the ink tank 303. The through hole 205A is provided with an O-ring or the like (not illustrated) so that the ink in the first ink chamber 301 does not leak from the through hole 205A. Then, the first lever arm 206 can rotate in the first ink chamber 301 with the rotation shaft 205 as a center of rotation in conjunction with a rotation operation of the second lever arm 203 arranged on the right side wall of the ink tank 303.

The valve body 207 includes the seal member 209 which seals a communication passage 220 which communicates the first ink chamber 301 and the second ink chamber 401 and is rotatably coupled to the first lever arm 206 via a connecting portion. Then, the valve body 207 moves up and down as the slider member 202 moves, the second lever arm 203 rotates, and the first lever arm 206 rotates as the cap 304 opens or closes. As a result, the seal member 209 sits or separates from a valve seat 210 to open or close the communication passage 220 which communicates the first ink chamber 301 and the second ink chamber 401.

In addition, the ink tank 303 includes an ink outlet 360 for supplying ink to a recording head 310 and an atmospheric communication port 370 for communicating the inside of the second ink chamber 401 to the outside of the ink tank 303. The ink outlet 360 is provided in the second ink chamber 401. Although the atmospheric communication port 370 is provided at an upper portion of the ink tank 303, an atmospheric communication passage 371 for communicating the atmospheric communication port 370 with the inside of the second ink chamber 401 extends to the second ink chamber 401.

Further, the ink tank 303 is provided with a visual recognition portion 350 on a front side of the ink tank body 306. Since the ink tank body 306 is made of a resin which transmits light rays or a translucent resin, a user can check a remaining amount of ink in the ink tank 303 simply by looking at the visual recognition portion 350. The visual recognition portion 350 is provided with an upper limit indicator 351 and a lower limit indicator 352. The upper limit indicator 351 displays a liquid level height of a maximum capacity of ink which can be stored in the ink tank 303. On the other hand, the lower limit indicator 352 displays a liquid level height which encourages a user to inject ink into the ink tank 303.

SUMMARY

One illustrative aspect of the present disclosure provides an ink tank configured to supply liquid to an apparatus having a liquid consumption device, the ink tank including: a first liquid storage chamber configured to store liquid, the first liquid chamber including a visual recognition portion having a lower limit indicator indicating a liquid level height prompting a user to inject liquid; a second liquid storage chamber connected to the first liquid storage chamber through a communication passage, the second liquid storage chamber having a liquid supply port supplying liquid to the liquid consumption device; a liquid inlet which communicates with the first liquid storage chamber; a cap openable or closeable with respect to the liquid inlet; a rotation shaft extending from an inside of the first liquid storage chamber to an outside of the ink tank through a through hole, the through hole being provided on a side wall of the first liquid storage chamber; a valve member provided in the first liquid storage chamber, the valve member being moveable so as to open or close the communication passage; a first lever arm rotatable around the rotation shaft as a center of rotation in the first liquid storage chamber, the first lever arm being connected to the valve member; a second lever arm provided outside the ink tank, the second lever arm being rotatable around the rotation shaft as the center of rotation; and a slider member provided outside the ink tank and connected to the second lever arm, the slide member being movable in an up-down direction in conjunction with an opening and closing operation of the cap, wherein the through hole is provided at a position above the lower limit indicator.

According to the ink tank according to the disclosure and the image recording apparatus using the ink tank, even when the structure is such that the valve inside the tank is opened or closed by the link mechanism equipped with the rotation shaft which connects the inside and outside of the ink tank, the possibility of liquid leakage can be reduced.

BRIEF DESCRIPTION OF DRAWINGS

Illustrative embodiments of the present disclosure will be described in detail based on the following figures, wherein:

FIG. 1A illustrates a perspective view of an image recording apparatus 300 with an opening and closing cover 307 open and FIG. 1B illustrates a partially enlarged view of the image recording apparatus 300.

FIG. 4A illustrates a schematic view of a state in which the cap 304 is separated from the link mechanism (a valve member is sealed) and FIG. 4B illustrates a schematic view of a state in which the link mechanism is operated by the cap 304 in the closed position (the valve member is opened).

FIG. 5A illustrates a schematic view of a state in which the cap 504 is separated from the link mechanism (a valve member is sealed) and FIG. 5B illustrates a schematic view of a state in which the link mechanism is operated by the cap 504 in a closed position (the valve member is opened).

DETAILED DESCRIPTION

Figure 1B:
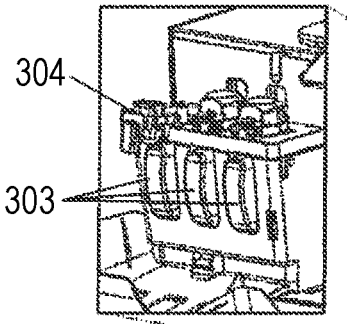
FIGS. 1A and 1B are perspective views of an image recording apparatus, where
Figure 1A:
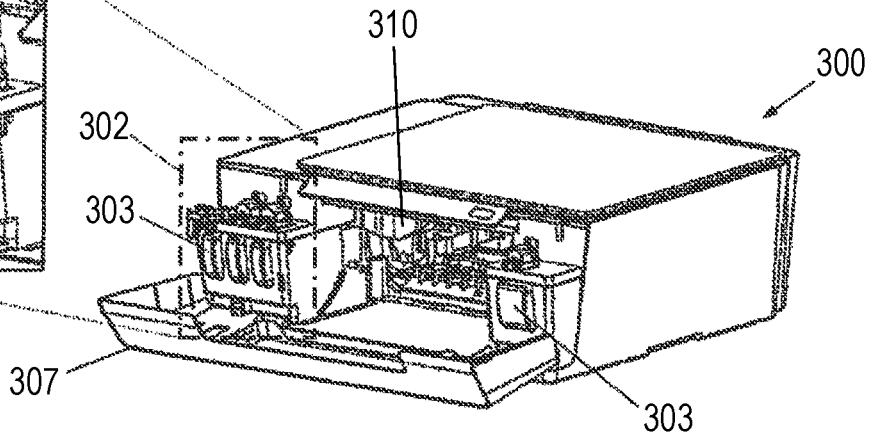
Figure 1A:
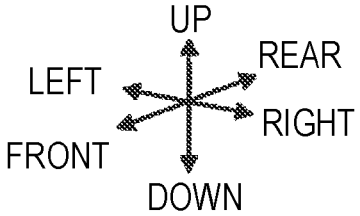
Figure 2:
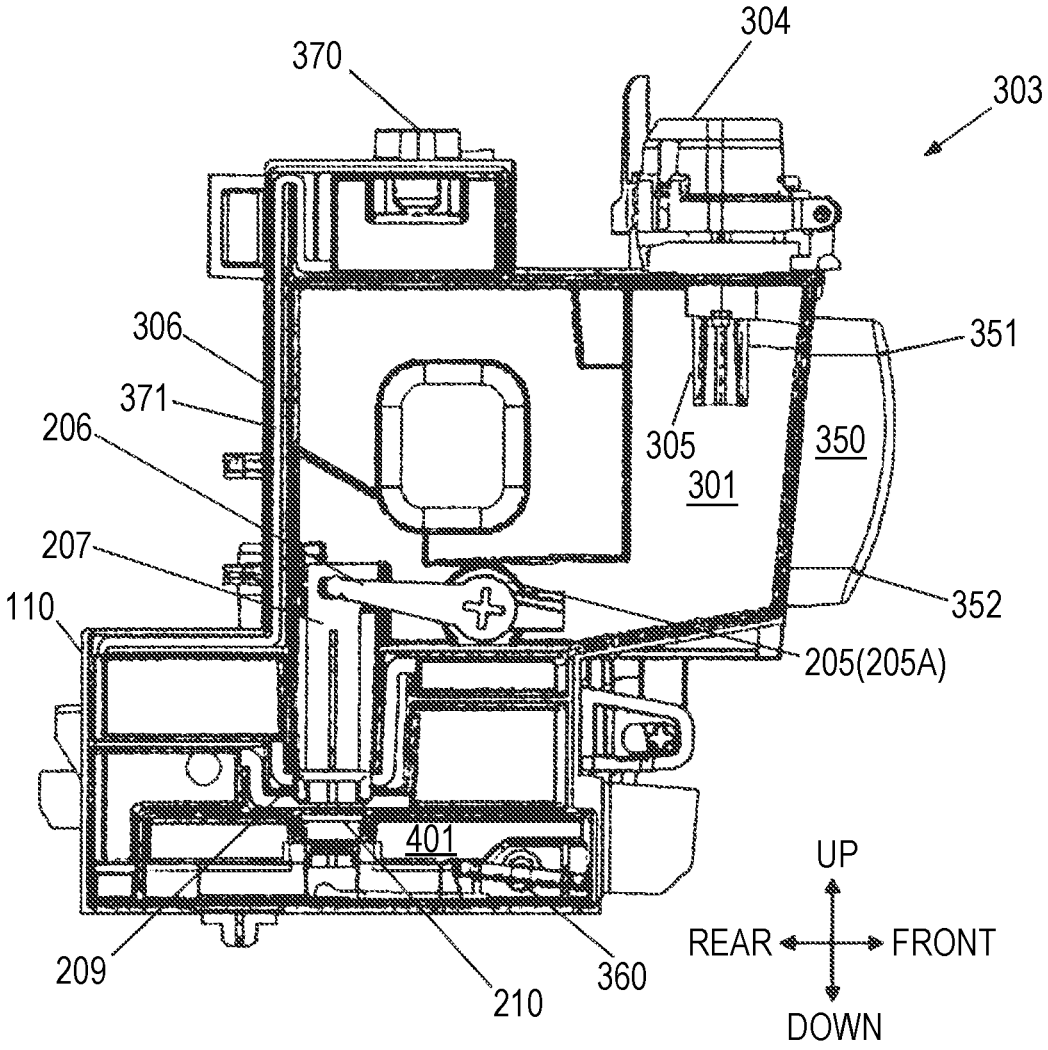
FIG. 2 is a left side view of an ink tank 303 of the related art in a state where a cap 304 is in a closed position.
Figure 3:
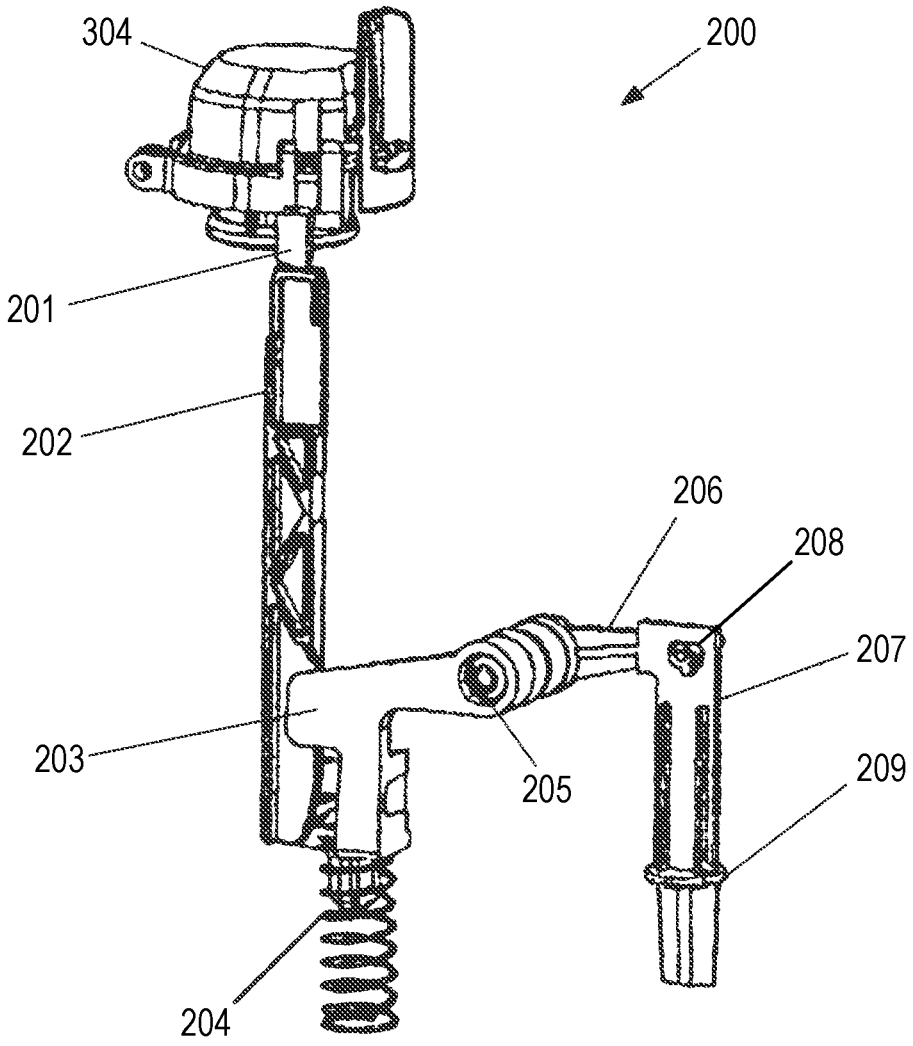
FIG. 3 is a perspective view illustrating only a link mechanism 200 used in the ink tank 303 of the related art by extracting it.
Figure 4A:
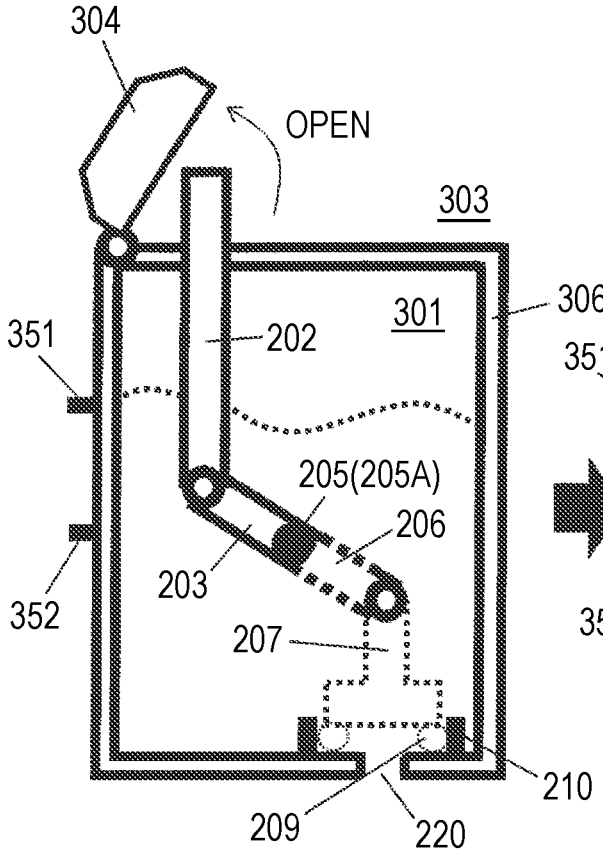
FIGS. 4A and 4B are schematic views briefly illustrating an operation of the cap 304 and the link mechanism of the related art, where
Figure 4B:
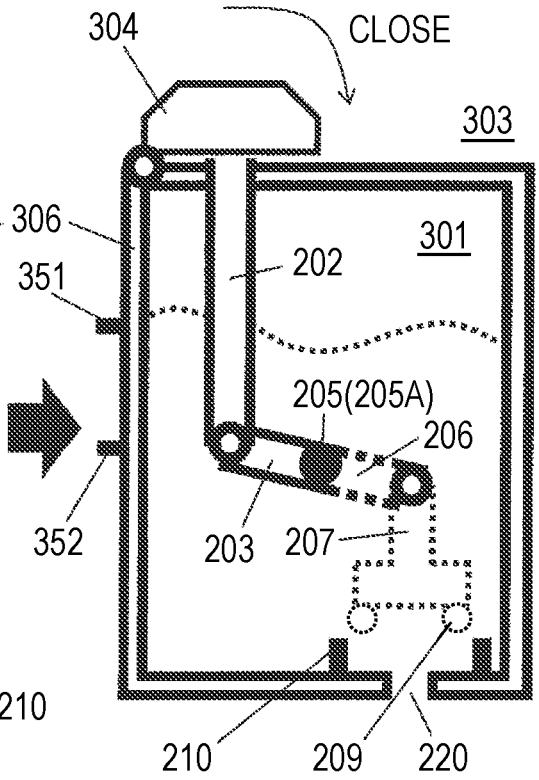

In the above-described related-art ink tank structure, the link mechanism is required to connect the parts provided inside the ink tank and the parts provided outside the ink tank. Specifically, it is necessary to connect the second lever arm located outside the ink tank to the rotation shaft 205 of the first lever arm 206 provided in the first ink chamber. Therefore, the through hole 205A for the rotation shaft 205 to penetrate is provided on the right side wall made of resin forming the first ink chamber 301 and the rotation shaft 205 extends from the inside of the first ink chamber 301 toward the outside of the ink tank through the through hole 205A. Further, the rotation shaft 205 and the through hole 205A are arranged below the lower limit indicator 352. Therefore, when the maximum amount of ink which can be stored in the ink tank 303 is stored, that is, when the liquid level of the ink is at the upper limit indicator 351, the rotation shaft 205 and the through hole 205A will be located below the ink liquid level. Therefore, even when the rotation shaft 205 and the through hole 205A are sealed with a seal member such as an O-ring, there is a risk that the ink in the ink tank 303 may leak out of the ink tank from the through hole 205A due to aged deterioration or deformation of the seal member.

Therefore, one illustrative aspect of the disclosure has been made to solve the above-explained problems.

Hereinafter, an illustrative embodiment of the disclosure will be described. It goes without saying that the illustrative embodiment described below is merely an example of the disclosure and the illustrative embodiment of the disclosure can be appropriately changed without changing the scope of the disclosure.

Figure 5A:
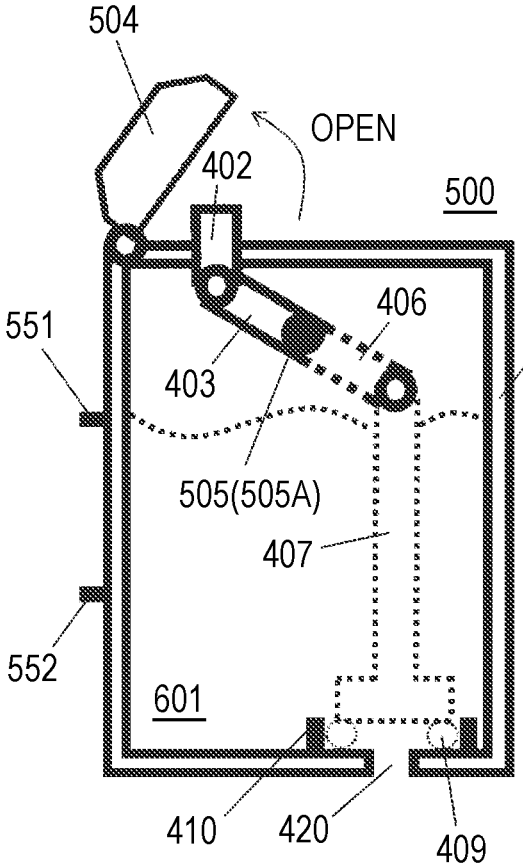
FIGS. 5A and 5B are schematic views briefly illustrating an operation of a cap 504 and a link mechanism of an illustrative embodiment, where
Figure 5B:
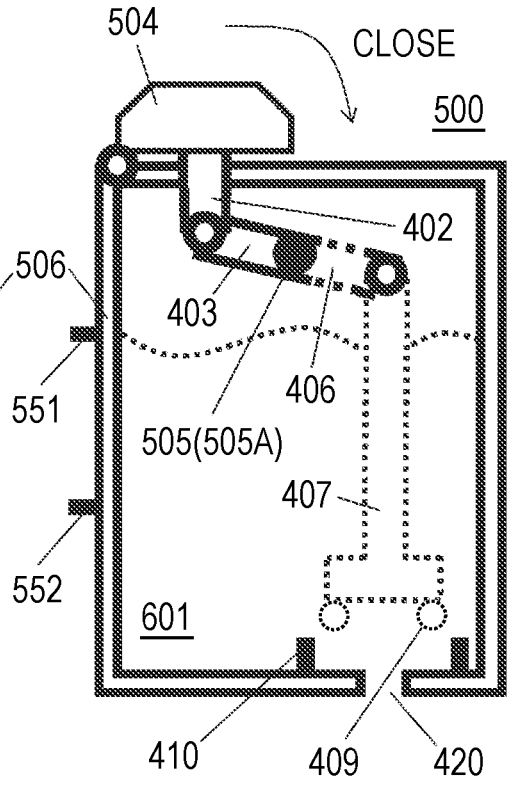

FIGS. 5A and 5B are schematic views briefly illustrating an operation of a cap 504 and a link mechanism of an illustrative embodiment, where FIG. 5A illustrates a schematic view of a state in which the cap 504 is separated from the link mechanism (a valve member is sealed) and FIG. 5B illustrates a schematic view of a state in which the link mechanism is operated by the cap 504 in a closed position (the valve member is opened). However, FIGS. 5A and 5B do not illustrate a second ink chamber (an example of a second liquid storage chamber) provided below a first ink chamber 601 (an example of a first liquid storage chamber).

An ink tank 500 described below is used for an inkjet recording apparatus which is an example of an image recording apparatus and the inkjet recording apparatus includes an inkjet recording type recording head which is an example of a liquid consumption device.

Similar to an ink tank 303, the ink tank 500 has the cap 504 which can seal an injection cylinder rotatably attached to an ink tank body 506. The cap 504 is always urged from a closed position to an open position by an elastic body (for example, a rubber O-ring) (not illustrated). When an engaging portion of the cap 504 is disengaged, the cap 504 rotates by itself from the closed position where the injection cylinder is sealed to the open position. In addition, the ink tank 500 includes a valve structure which opens or closes a communication passage 420 from the first ink chamber 601 to a second ink chamber (not illustrated) arranged below the first ink chamber 601 in conjunction with opening or closing of the cap 504. When the cap 504 is in the open position, a seal member 409 of a valve body 407, which is the valve body, comes into contact with a valve seat 410 to block the communication passage 420, and when the cap 504 is in the closed position, the seal member 409 of the valve body 407 is separated from the valve seat 410 to open the communication passage 420.

The valve structure is composed of a slider member 402, a second lever arm 403, a first lever arm 406, the valve body 407, an urging member (not illustrated), and a plurality of rubber seal members (O-rings or the like). The urging member (not illustrated) may have any structure as long as it exhibits the same function as an urging member (compression spring) 204 used in the ink tank 303 of the related art and always urges the second lever arm 403 upward. As a result, the urging member (not illustrated) urges the slider member 402 upward.

The slider member 402, the second lever arm 403, and the urging member are provided on the outside of the ink tank 500. On the other hand, a rotation shaft 505 of the first lever arm 406 penetrates a through hole 505A provided in a side wall forming the first ink chamber 601 from the inside of the first ink chamber 601 toward the outside of the ink tank 500. An O-ring is provided at the portion of the through hole 505A so that the ink in the first ink chamber 601 does not leak from the through hole 505A. The first lever arm 406 can rotate in the first ink chamber 601 with the rotation shaft 505 as a center of rotation in conjunction with a rotation operation of the second lever arm 403 provided outside the ink tank 500.

The valve body 407 includes the seal member 409 which seals the communication passage 420 which connects the first ink chamber 601 and the second ink chamber (not illustrated) and is rotatably coupled to the first lever arm 406. Then, the valve body 407 moves up and down in response to the movement of the slider member 402, the rotation of the second lever arm 403, and the rotation of the first lever arm 406 accompanying the opening and closing operation of the cap 504. As a result, when the seal member 407A sits on or separates from the valve seat 410, the communication passage 420 which communicates the first ink chamber 601 and the second ink chamber is opened or closed.

Here, in the ink tank structure, the rotation shaft 505 of the first lever arm 406 penetrates the through hole 505A provided on the side wall forming the first ink chamber 601 from the inside of the first ink chamber 601 toward the outside of the ink tank 500. Especially when a maximum amount of ink which can be stored in the ink tank 500 is stored, that is, even when a liquid level of the ink is at an upper limit indicator 551, the rotation shaft 505 and the through hole 505A are provided above the upper limit indicator 551. Therefore, even when aged deterioration or deformation occurs in the seal member such as the O-ring which seals the rotation shaft 505 and the through hole 505A, the possibility that the ink in the ink tank 500 leaks out of the ink tank from the through hole 505A can be extremely reduced.

MODIFICATION EXAMPLE

In the illustrative embodiment described above, the rotation shaft 505 and the through hole 505A are provided above the upper limit indicator 551. However, so long as the rotation shaft 505 and the through hole 505A are provided above the lower limit indicator 552, the possibility of ink leakage can be reduced as compared with the ink tank 303 of the related art.

In addition, the rotation shaft 505 and the through hole 505A may be provided at positions above the lower limit indicator 552 and below the upper limit indicator 551. According thereto, the possibility of ink leakage can be further reduced as compared with the ink tank 303 of the related art.

What is claimed is:

1. An ink tank configured to supply liquid to an apparatus having a liquid consumption device, the ink tank comprising:

a first liquid storage chamber configured to store liquid, the first liquid chamber comprising a visual recognition portion having a lower limit indicator indicating a liquid level height prompting a user to inject liquid;

a second liquid storage chamber connected to the first liquid storage chamber through a communication passage, the second liquid storage chamber having a liquid supply port supplying liquid to the liquid consumption device;

a liquid inlet which communicates with the first liquid storage chamber;

a cap openable or closeable with respect to the liquid inlet;

a rotation shaft extending from an inside of the first liquid storage chamber to an outside of the ink tank through a through hole, the through hole being provided on a side wall of the first liquid storage chamber;

a valve member provided in the first liquid storage chamber, the valve member being moveable so as to open or close the communication passage;

a first lever arm rotatable around the rotation shaft as a center of rotation in the first liquid storage chamber, the first lever arm being connected to the valve member;

a second lever arm provided outside the ink tank, the second lever arm being rotatable around the rotation shaft as the center of rotation; and a slider member provided outside the ink tank and connected to the second lever arm, the slider member being movable in an up-down direction in conjunction with an opening and closing operation of the cap, wherein the through hole is provided at a position above the lower limit indicator.

2. The ink tank according to claim 1, wherein the visual recognition portion comprises an upper limit indicator indicating a liquid level height of a maximum capacity of liquid allowed for storage in the ink tank, and wherein the through hole is provided at a position above the upper limit indicator.

3. The ink tank according to claim 1, wherein the visual recognition portion comprises an upper limit indicator indicating a liquid level height of a maximum capacity of liquid allowed for storage in the ink tank, and wherein the through hole is provided at a position below the upper limit indicator.

4. An image recording apparatus comprising:

a liquid consumption device; and the ink tank according to claim 1 configured to supply liquid to the liquid consumption device.

5. The ink tank according to claim 1, wherein at least one of the first lever arm or the second lever arm is provided at a position above the lower limit indicator.

6. The ink tank according to claim 5, wherein the first lever arm is provided at the position above the lower limit indicator.

7. The ink tank according to claim 5, wherein the second lever arm is provided at a position above the lower limit indicator.

8. The ink tank according to claim 5, wherein the first lever arm and the second lever arm are both provided at positions above the lower limit indicator.

9. The ink tank according to claim 1, wherein the visual recognition portion further comprises an upper limit indicator indicating a liquid level height of a maximum capacity of liquid allowed for storage in the ink tank, and wherein the first lever arm and the second lever arm are both provided at positions above the lower limit indicator and the upper limit indicator.

10. An ink tank configured to supply liquid to a device having a liquid consumption device, the ink tank comprising:

a first liquid storage chamber configured to store liquid, the first liquid storage chamber comprising a visual recognition portion having an upper limit indicator indicating a liquid level height of a maximum capacity allowed for storage;

a second liquid storage chamber connected to the first liquid storage chamber through a communication passage, the second liquid storage chamber having a liquid supply port supplying liquid to the liquid consumption device;

a liquid inlet which communicates with the first liquid storage chamber;

a cap openable or closeable with respect to the liquid inlet;

a rotation shaft extending from an inside of the first liquid storage chamber to an outside of the ink tank through a through hole, the through hole being provided on a side wall of the first liquid storage chamber;

a valve member provided in the first liquid storage chamber, the valve member being moveable so as to open or close the communication passage;

a first lever arm rotatable around the rotation shaft as a center of rotation in the first liquid storage chamber, the first lever arm being connected to the valve member;

a second lever arm provided outside the ink tank, the second lever arm being rotatable around the rotation shaft as the center of rotation; and a slider member provided outside the ink tank and connected to the second lever arm, the slider member being movable in an up-down direction in conjunction with an opening and closing operation of the cap, wherein the through hole is provided at a position above the upper limit indicator.

11. An image recording apparatus comprising:

a liquid consumption device; and the ink tank according to claim 10 configured to supply liquid to the liquid consumption device.

12. The ink tank according to claim 10, wherein at least one of the first lever arm or the second lever arm is provided at a position above the upper limit indicator.

13. The ink tank according to claim 12, wherein the first lever arm is provided at the position above the upper limit indicator.

14. The ink tank according to claim 12, wherein the second lever arm is provided at the position above the upper limit indicator.

15. The ink tank according to claim 12, wherein the first lever arm and the second lever arm are both provided at positions above the upper limit indicator.

* * * * *